US005697806A

United States Patent [19]

Whiteman, Jr. et al.

[11] Patent Number: 5,697,806

[45] Date of Patent: Dec. 16, 1997

[54] STACKABLE ELECTRICAL CONNECTOR

[75] Inventors: Robert Neil Whiteman, Jr., Middletown; Robert Wayne Walker, Harrisburg; James Philip Moser, Steelton; Earl William McCleerey, Mechanicsburg; Keith Scott Koegel, Plainfield, all of Pa.

[73] Assignee: The Whitaker Corporation, Wilmington, Del.

[21] Appl. No.: 675,131

[22] Filed: Jul. 3, 1996

Related U.S. Application Data

[60] Provisional application No. 60/000,923, Jul. 6, 1995.

[51] Int. Cl.[6] ..... H01R 13/28

[52] U.S. Cl. ..... 439/417; 439/98; 439/353; 439/466; 439/651

[58] Field of Search ..... 439/651, 652, 439/653, 638, 284, 610, 466, 404, 405, 417, 106, 98

[56] References Cited

U.S. PATENT DOCUMENTS

| | | | |
|---|---|---|---|
| 4,909,746 | 3/1990 | Scholz | 439/82 |
| 5,551,882 | 9/1996 | Whiteman, Jr. et al. | 439/21 |
| 5,564,950 | 10/1996 | Loman et al. | 439/417 |

*Primary Examiner*—Neil Abrams
*Assistant Examiner*—Barry Matthew L. Standig
*Attorney, Agent, or Firm*—Anton P. Ness

[57] ABSTRACT

An electrical connector (10) terminating a multi-wire cable (56) and adapted for mating contact with another such connector of identical construction. The connector comprises a plurality of hermaphroditic contact members (12) retained within a housing (14,16). The housing includes channels (52) for holding the wires (54) of the cable and the contact members further have insulation displacing contact portions (36) adapted to engage respective ones of the wires. The housing is formed of two parts with a latching mechanism (58,60, 62,64).

18 Claims, 5 Drawing Sheets

STACKABLE ELECTRICAL CONNECTOR

This application claims the benefit of U.S. Provisional Application No. 60/000,923, filed Jul. 6, 1995.

FIELD OF THE INVENTION

This invention relates to an electrical connector adapted to be plugged into an outlet and, more particularly, to such a connector that is further adapted to be plugged into another connector of identical construction to form a stacked array.

BACKGROUND OF THE INVENTION

In a workplace environment, electrically powered machines are often brought together in a group to perform a sequence of machine operations. Each of the machines requires a connection to a source of electrical power and, in addition, the machines may be controlled by electronic signals to perform their individual operations. Thus, each of the machines is typically equipped with an electrical cable terminated by a connector which is adapted to be plugged into an outlet receptacle that supplies electrical power and other electrical signals to the machine. Therefore, a sufficient number of such receptacles must be conveniently located to assure that all of the machines have access to the electrical power and signals. A common practice is to provide an abundance of outlet receptacles so as to avoid the possibility of a shortage of such receptacles. However, such practice typically results in an excess number of receptacles being available. A problem with this approach is that such receptacles are costly and receptacles that are used even infrequently need repairs and maintenance. It is therefore an object of this invention to reduce the need for an abundance of receptacle outlets, together with reducing the cost and maintenance associated with such receptacle outlets.

U.S. patent application Ser. No. 08/409,128, filed Mar. 22, 1995, and assigned to the assignee of this invention, proposes to satisfy this objective by providing an electrical connector constructed to mate with a connector of identical construction. That connector comprises a front mating ring, multiple contacts brushing respective concentric circuits on a rotatable circuit board, which contacts are connected to respective wires of an electrical cable, a rear facing socket receiving a front mating ring of another identical connector, and the front mating ring and rear facing socket being connected electrically together. While effective, it has been found that such a connector requires a relatively large number of parts, is relatively large in overall size, and has a large lever handle that is angularly offset from the handle of a mating connector, which can result in an inconvenient configuration of connectors and cables. It is therefore another object of the present invention to provide an electrical connector which satisfies the above objective while at the same time overcoming the disadvantages of the aforedescribed connector.

SUMMARY OF THE INVENTION

The foregoing add additional objects are attained in accordance with the principles of this invention by providing an electrical connector terminating a multi-wire cable and adapted for mating contact with another such connector of identical construction so as to provide a stacked assembly of connectors with electrical continuity therebetween. The connector comprises a plurality of contact members each having complementary plug and receptacle portions, with the plug and receptacle portions of each contact member being oppositely directed along a major axis of each contact member. Each of the contact members further has means for contacting a respective wire of the cable. The connector further comprises an insulative housing for the plurality of contact members. The housing is formed with a plurality of parallel through-channels each for containing a respective one of the plurality of contact members so that the plug portions extend outwardly from a first face of the housing and the receptacle portions are accessible at a second face of the housing. The second housing face is parallel and opposed to the first housing face and the first and second faces are transverse to the major axes of the plurality of contact members. The housing is formed of two parts, with one of the housing parts being formed with means for holding the wires of the cable in spaced parallel relation.

In accordance with an aspect of this invention, the housing parts are formed with cooperating latch means for holding the housing parts together in two positions. A first of the positions is a preliminary assembly position wherein the housing parts are in spaced alignment, with the contacting means of the contact members being spaced from the wires. The other position is the final assembled position wherein the contacting means of the contact members each engages a respective cable wire.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
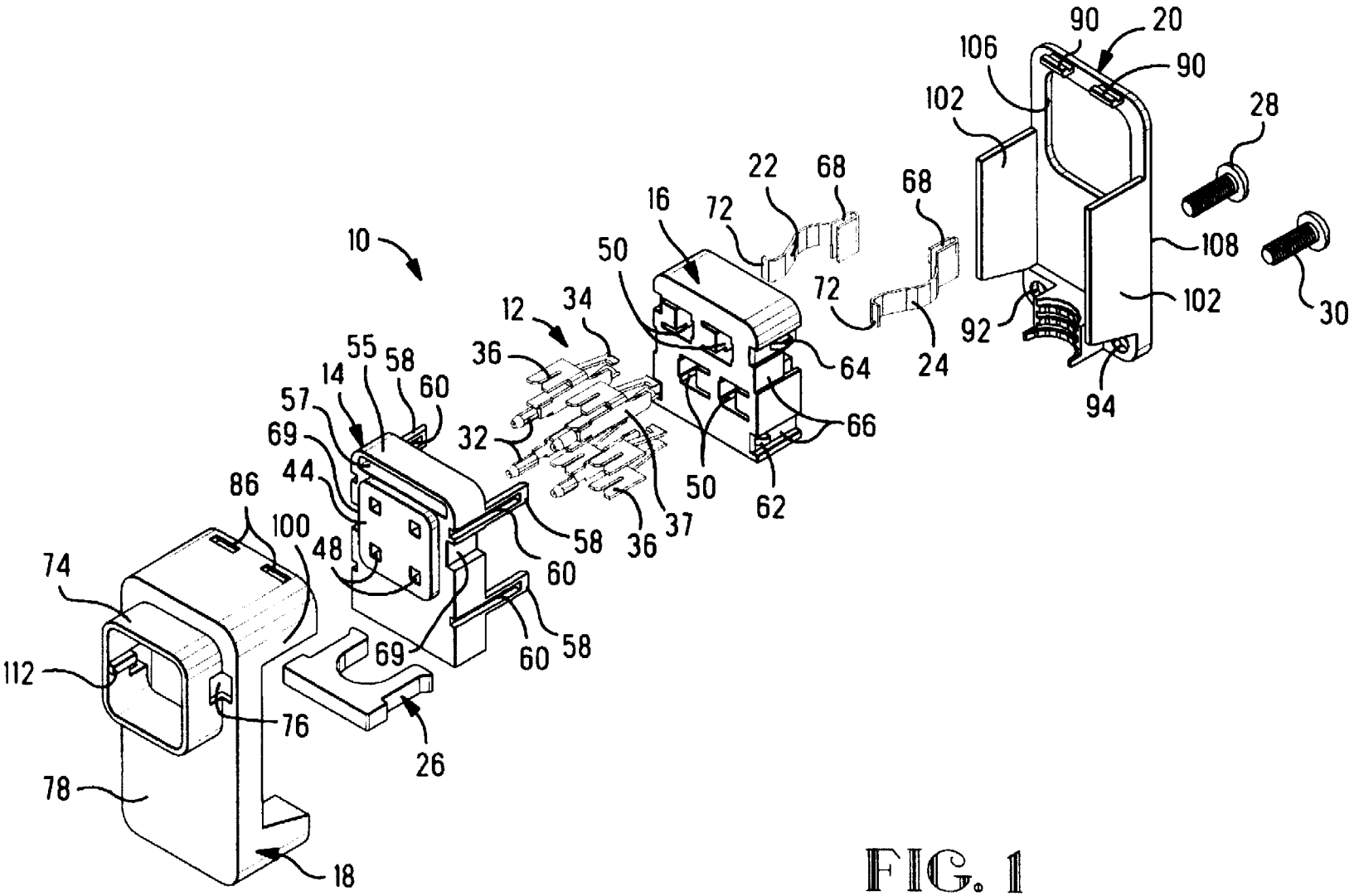
FIG. 1 is a front exploded perspective view of an electrical connector constructed in accordance with the principles of this invention.
Figure 2:
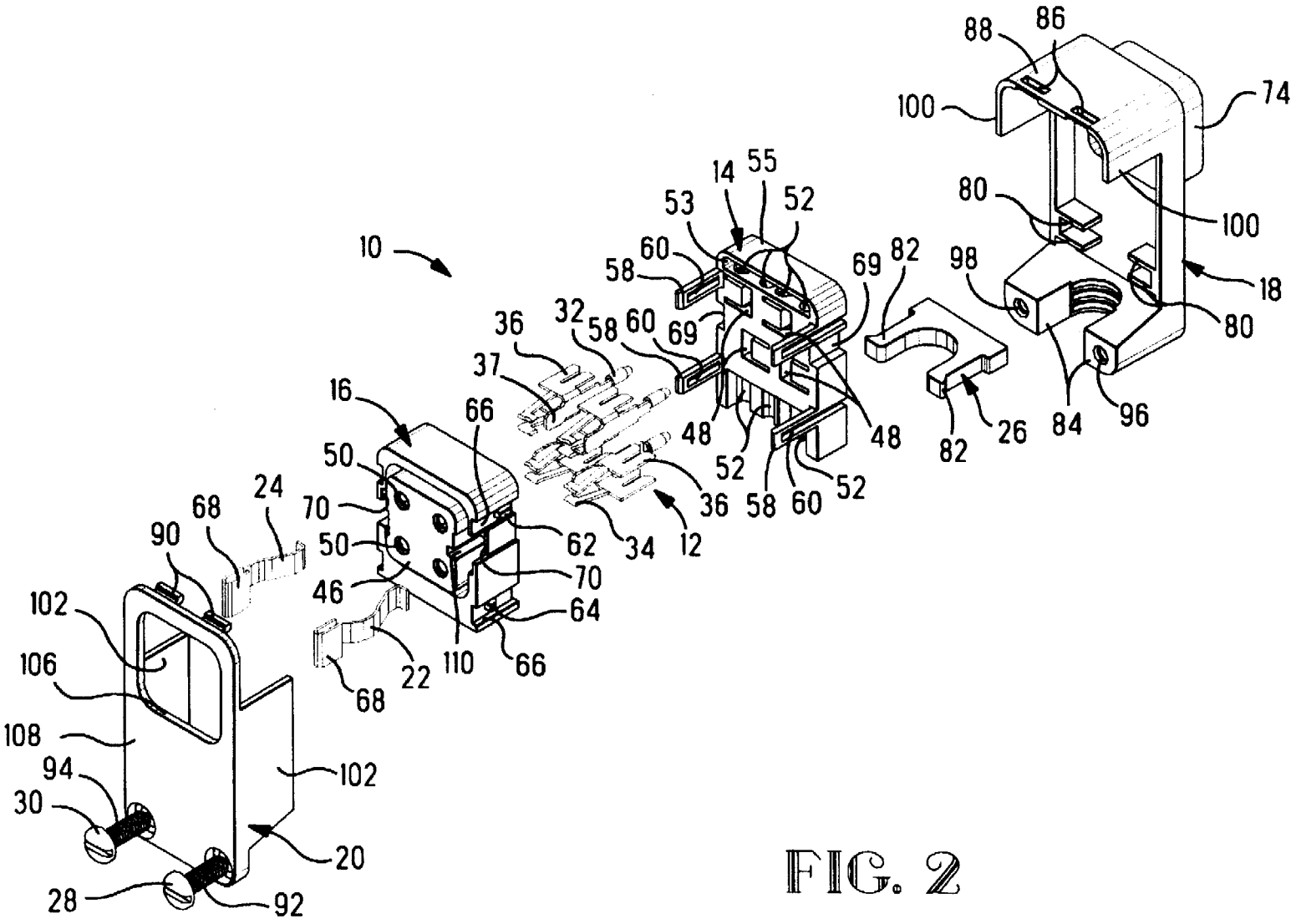
FIG. 2 is a rear exploded perspective view of the connector of FIG. 1.

FIGS. 1 and 2 show all of the parts of a connector constructed according to the principles of this invention and designated generally by the reference numeral 10. The primary components of the connector 10 are the conductive contact members 12, the two insulative housing parts 14,16 and the two electrically conductive cover parts 18,20. In addition, the connector 10 includes a pair of spring clips 22,24, a deformable cable strain relief clamp 26, and a pair of screws 28,30.

Each of the contact members 12 is hermaphroditic, having a male plug portion 32 and a complementary female receptacle portion 34. As shown, each of the contact members 12 is preferably formed from sheet stock material which is stamped and formed into a generally elongated contact member having a major axis, with the plug portion 32 and the receptacle portion 34 being oppositely directed from each other along that major axis. The plug portion 32 is adapted to mate with a receptacle portion 34 of another identical contact member. Illustratively, the plug portion 32 is substantially cylindrical with a frusto-conical tapered forward end and the receptacle portion 34 is formed by a pair of inwardly tapering spring fingers. In addition to the plug portion 32 and the receptacle portion 34, each of the contact members 12 includes a generally planar insulation displacing contact portion 36 having, as clearly shown in FIGS. 3 and 4, a pair of blades 38, 40 separated by an open ended slot 42 having a width slightly less than the thickness of an internal conductor within an insulated wire 54 (FIGS. 3 and 4) which is compressively engaged and electrically connected within the slot 42 of the contact portion 36, as is known in the art. Illustratively, each of the contact members 12 is formed with a parallel pair of the spaced contact portions 36. This insulation displacing contact design provides robust wire handling and tough insulation usage by having a redundant pair of contact portions with wide blades 38,40 which enhance the insulation cutting action. In addition, a contact member designed as described functions both as a plug and receptacle so that it acts as a through-carrier of signals, and also functions to provide a "pick-off" connection to a wire.

The insulative housing parts 14,16 are each formed with aligned through-channels to contain respective portions of respective contact members 12, arranged so that when the housing parts 14,16 are put together, the contact members 12 are retained within the respective through-channels with the plug portions 32 extending outwardly from a first face 44 of the housing and the receptacle portions 34 being accessible at a second face 46 of the housing (see FIG. 2), as will be described. Thus, the first housing part 14 includes through-channels 48 for holding the plug portions 32 and part of the insulation displacing contact portions 36 of respective contact members 12. Similarly, the second housing part 16 is formed with through-channels 50 for holding the receptacle portions 34 and the remaining parts of the insulation displacing contact portions 36 of the respective ones of the contact members 12. Specifically, the contact members 12 are retained in the through-channels 50 of the housing part 16 by an interference fit. Respective pairs of the through-channels 48,50 are aligned with each other so that when the housing parts 14,16 are joined together, complete through-channels for the contact members 12 are provided. These complete through-channels are parallel to each other so that the major axes of the retained contact members 12 are parallel to each other. The housing faces 44,46 are transverse to the major axes of the contact members 12, and are preferably orthogonal thereto.

As described above, the housing is formed of two parts 14,16. The parts 14,16 preferably meet substantially along a plane orthogonal to the major axes of the contact members 12. The housing part 14 is formed with a plurality of parallel spaced channels 52 for holding the individual wires 54 of a cable 56 (see FIG. 5) terminated by the connector 10. Illustratively, there are four such wires 54, so that there are four channels 52 and four contact members 12.

To hold the housing parts 14,16 together, the housing part 14 is formed with a plurality of parallel resilient latch fingers 58 which extend in parallel relation toward the housing part 16. Each of the latch fingers 58 is formed with an elongated closed ended slot 60. To cooperate with the latch fingers 58 and thereby effect a latching function, the housing part 16 is formed with a plurality of latch projections 62, 64. Each of the latch projections 62,64 corresponds to a respective one of the latch fingers 58. Illustratively, there are four latch fingers 58, two latch projections 62 and two latch projections 64. The latch projections 62 are closer to the housing part 14 than are the latch projections 64. Each of the latch projections 62,64 is disposed in a respective recessed channel 66 sized and shaped to accommodate therein a respective one of the latch fingers 58. Preferably, on a first side of the housing part 16, as shown in FIG. 1, the latch projection 62 is below the latch projection 64; and on the other side of the housing part 16, as shown in FIG. 2, the latch projection 62 is above the latch projection 64. The reasons for there being two groups of latch projections 62,64 is so that the latching occurs in two stages, a preliminary assembly position and a final assembly position, as will be described in full detail hereinafter.

Figure 3:
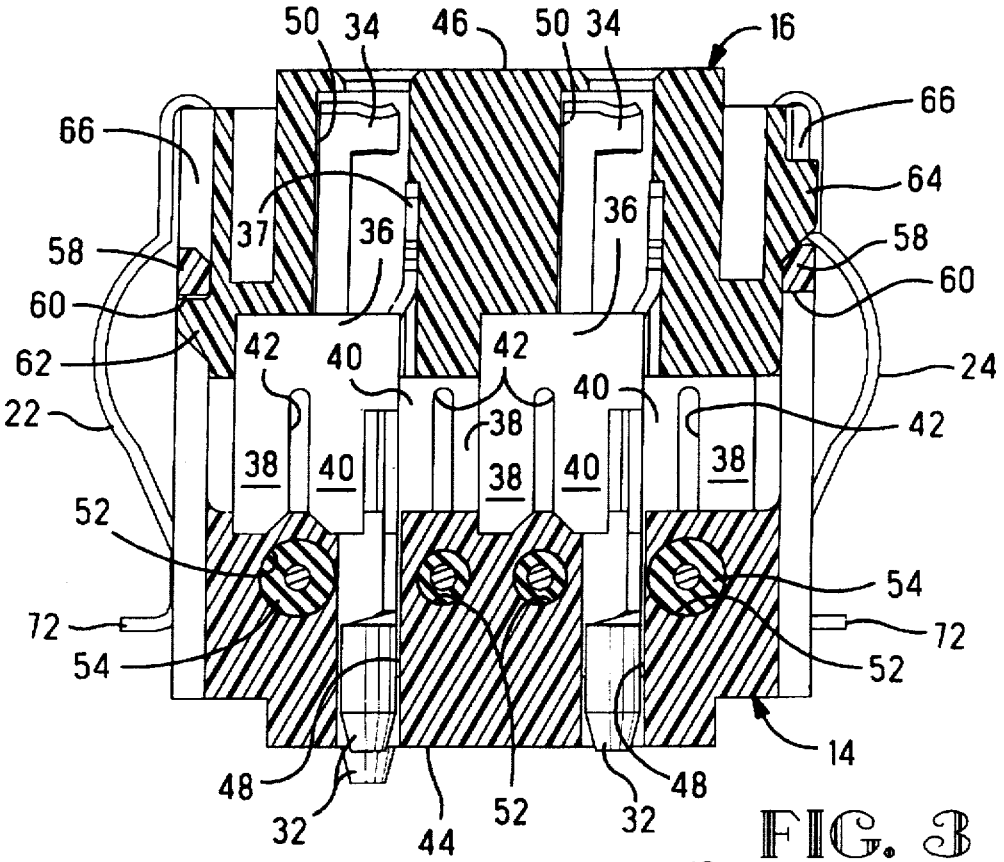
FIG. 3 is a cross sectional view showing the housing parts of the connector in their preliminary assembly position.

When assembling the connector 10, the contact members 12 are initially installed in the through-channels 50 of the housing part 16 and have support tabs 37 to maintain their position during insulation displacement termination of the wires thereto. The housing parts 14,16 are then brought into alignment so that the plug portions 32 of the contact members 12 enter the through-channels 48 of the housing part 14 and the resilient latch fingers 58 enter the respective channels 66. The latch projections 62,64 have beveled lead-in surfaces for initiating deflection of the latch arms upon initial engagement with surfaces of the latch arms to ride over the projections. The housing parts 14, 16 are then brought closer together until they reach a preliminary assembly position, as shown in FIG. 3, wherein the latch projections 62 have snapped into the closed ended slots 60 of their respective latch fingers 58 and the ends of the other latch fingers 58 abut against the latch projections 64. This provides a "detent" function when the housing parts 14,16 are in the preliminary assembly position. The preliminarily assembled connector 10 can then be shipped to a customer. To terminate the cable 56 with the connector 10, the outer insulation layer of the cable 56 is removed for a length substantially equal to the height of the housing part 14. The inner ground braid layer of the cable 56 is then folded over the outer insulation layer. The individual wires 54 of the cable 56 are then inserted into respective ones of the channels 52 of the housing part 14. The channels 52 terminate in an open space 53 (FIG. 2) whose upper wall 55 limits the travel of the wires 54 and also isolates the wires 54 from the cover part 18. The housing part 14 is formed with an opening 57 through which the open space 53 is visible, so that a visual inspection can insure that the wires 54 are in the proper channels 52 (by color coding of the wires 54) and that the insertion depth of the wires 54 is sufficient to insure contact with the contact members 12.

Figure 4:
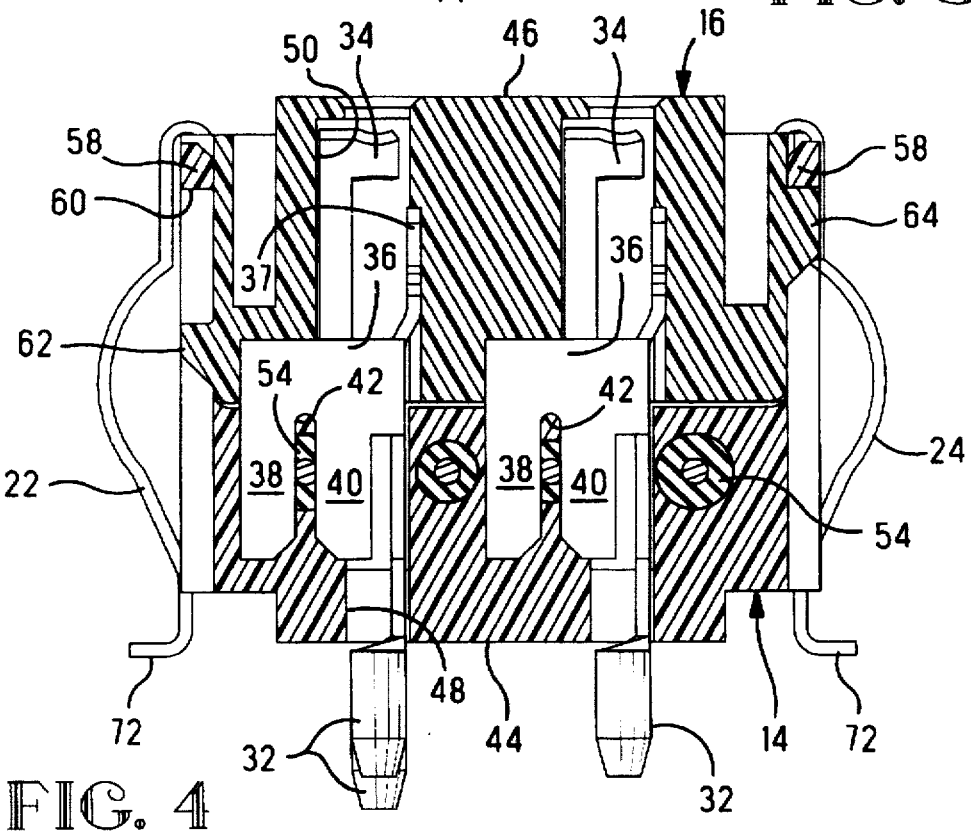
FIG. 4 is a cross sectional view showing the housing parts of the connector in their final assembly position.

In this preliminary assembly position (FIG. 3), the insulation displacing contact portions 36 of the contact members 12 have not yet engaged the respective wires 54. As the housing parts 14,16 are brought closer to each other, the contact portions 36 engage the wires 54 so that the blades 38,40 pierce the insulation of the wires 54 and the internal conductors of the wires 54 enter respective slots 42. Since the width of the slots 42 is slightly less than the diameter of the internal conductors of the wires 54, good electrical contact therebetween is assured. (Note that different size contact members 12 can be provided to accommodate different wire gauges.) In the final assembly position, as shown in FIG. 4, the internal conductors of the wires 54 are well within the slots 42 and the latch projections 64 have entered the elongated slots 60 of their respective latch fingers 58 to hold the housing parts 14,16 together. In this final assembly position, the plug portions 32 of the contact members 12 extend outwardly from the face 44 of the housing part 14 and the receptacle portions 34 of the contact members 12 are accessible for mating at the face 46 of the housing part 16.

The spring clips 22,24 each has a rear retainer 68 which is inserted into a slot 70 (FIG. 2) provided therefor in the housing part 16. The forward ends of the spring clips 22,24 have turned-out projections 72 which extend beyond, and are clear of, the front face 44 of the housing part 14 when the housing parts 14,16 are in the final assembly position, as is clear from FIG. 4.

The wires 54 are arranged such that adjacent wires extend side by side, FIG. 3, with all the wires 54 being in a row of wires 54. Ordinarily, the contact portions 36 that connect to the adjacent wires 54 are wider than the wires, and would need to be spaced apart or staggered, relatively widely if maintained in a common plane. The adjacent wires 54 then would be spaced apart, relatively widely, to align with such contact portions 36. To achieve compact spacing, the contact portions 36 that connect to the adjacent wires 54 are positioned in two different rows of contact portions 36, staggered axially with respect to the wires. The adjacent wires 54 then can be spaced closer together. To achieve compactness of the housing, the retainer slots 70 for the spring clips 22,24 are positioned along different rows of the contact portions 36 (FIG. 2). Stated another way, each slot 70 for the spring clip 22, or 24, is in a corresponding row of the contact portions 36. As a result, each of the staggered rows of the contact portions 36 is shorter than it would be if both slots 70 were to be in the same said row. Compactness is thereby achieved. The retainer slots 70 are separated by the housing, and are across the housing from each other. Further, the slots 70 are offset with respect to each other, being that they are in different rows of contact portions 36. The slots 70 are indented within opposite exterior sides of the housing. Similarly, the spring clips 22,24 received in the slots 70 are offset, and are indented within opposite exterior sides of the housing. Thereby, further compactness is achieved. Similarly, the housing part 14 is provided with indented portions 69 (FIG. 1) in opposite exterior sides of the housing part 14, which indented portions 69 are offset from each other across the housing, and which receive the spring clips 22 or 24.

Figure 5:
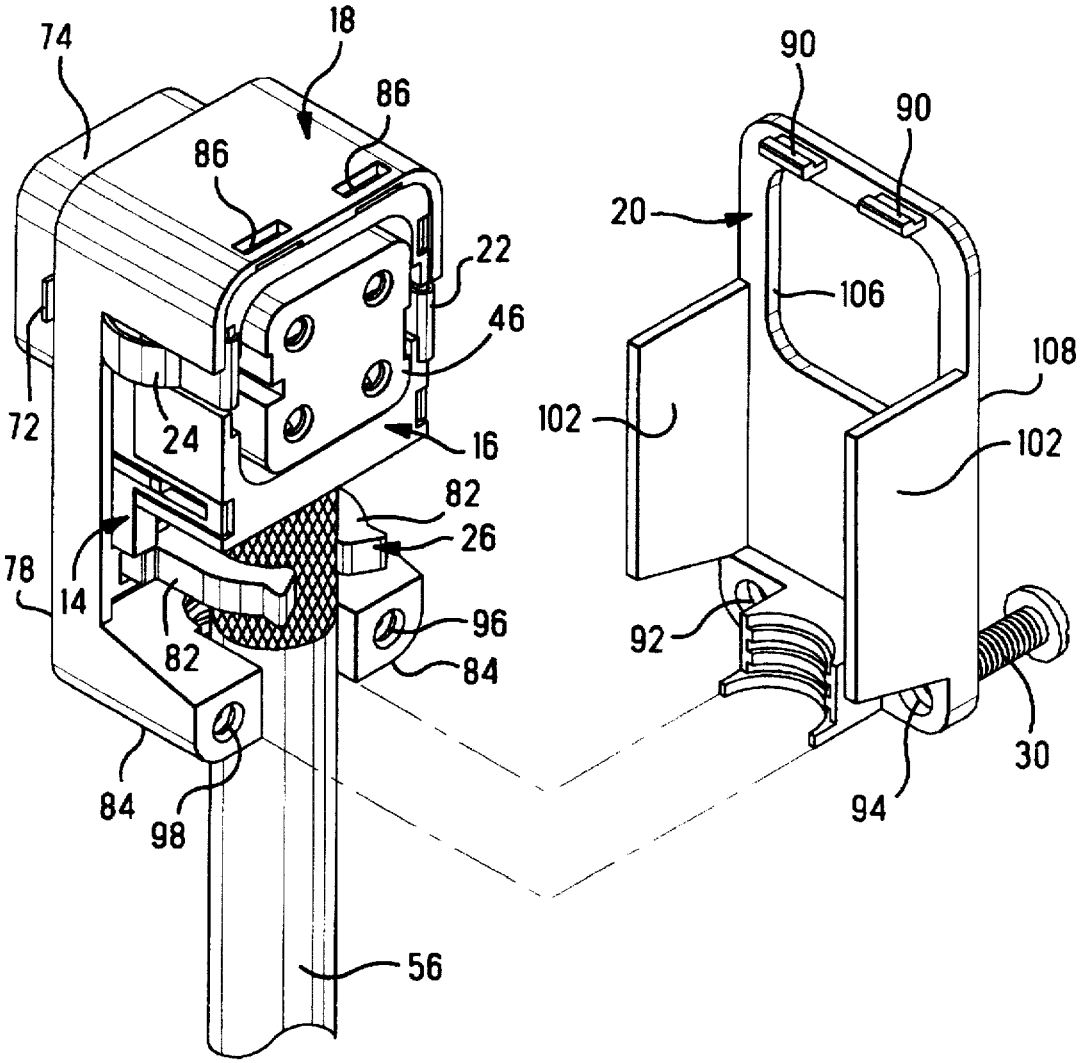
FIG. 5 is an exploded perspective view showing the mounting of a cover to the assembled housing parts.
Figure 6:
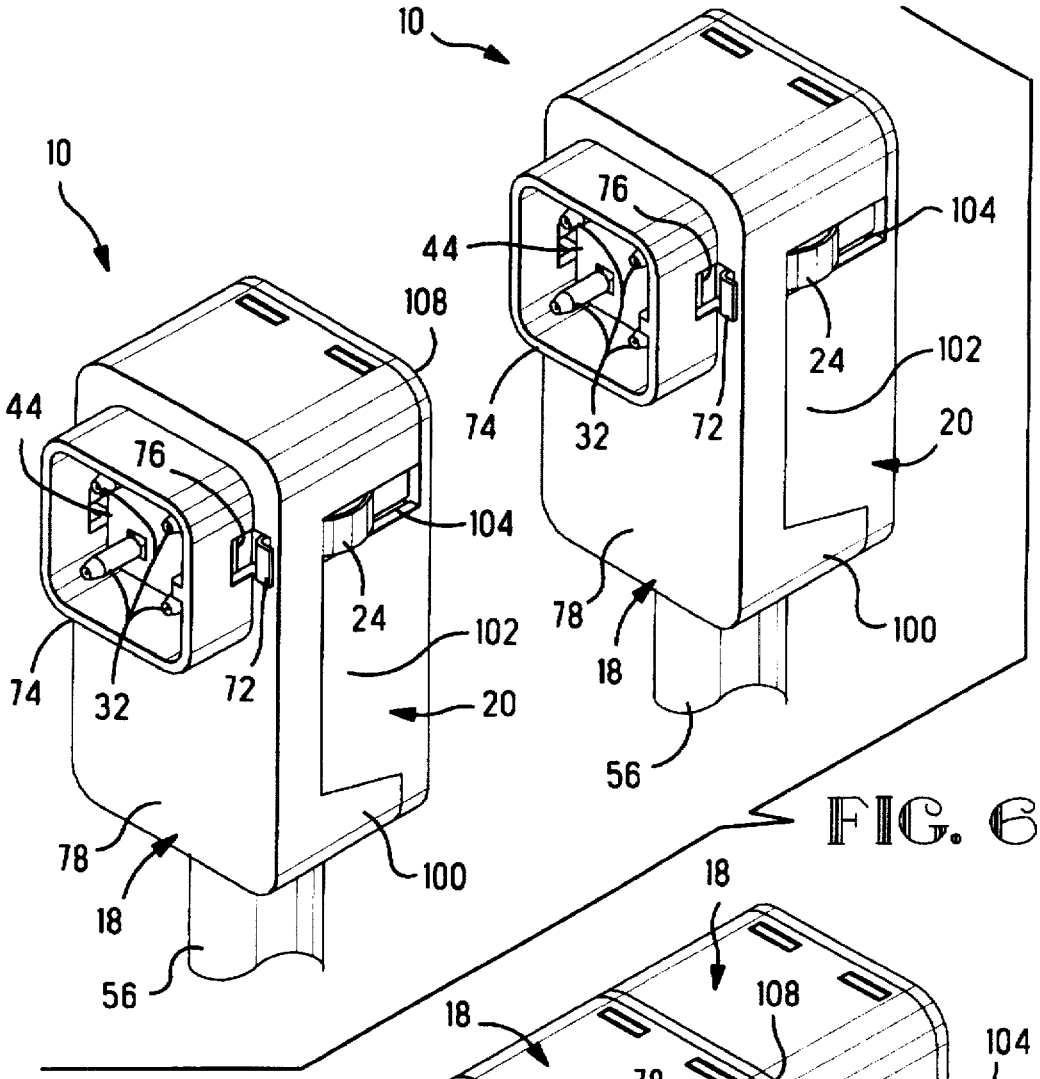
FIG. 6 shows two connectors aligned for mating.

Referring now to FIGS. 5 and 6, the cover part 18 is then installed over the housing part 14. The cover part 18 has an outwardly extending sleeve 74 which surrounds the contact member plug portions 32. The housing part 18 is formed with openings 76 on both sides of the sleeve 74 and also extending part way into the sleeve 74. These openings 76 allow the forward ends 72 of the spring clips 22,24 to extend therethrough, with the spring clips 22,24 being of sufficient length that the projections 72 are spaced from the front wall 78 of the cover part 18. Before installing the cover part 18 on the housing part 14, the cable clamp 26 is inserted into the space provided therefor in interference fit between the projections 80 formed on the inside of the cover part 18. Therefore, when the cover part 18 is installed on the housing part 14, the cable 56 that extends below the housing part 14 is surrounded by the legs 82 of the cable clamp 26 and the legs 84 of the cover part 18. The legs 82 of the cable clamp 26 are deformable and are squeezed together, for example, by using a pair of pliers, to firmly capture and compressively engage the cable 56 therebetween. The clamp 26 is formed of electrically conductive material so that when it engages the overlying braid layer of the cable 56, ground continuity between the cable 56 and the cover parts 18,20 is attained.

The cover part 18 is also formed with a pair of slits 86 on its upper wall 88. The cover part 20 is formed with a pair of L-shaped projections 90 which go into the slits 86 from below and allow the cover part 20 to then pivot into engagement with the cover part 18. The screws 28,30 are then placed through respective apertures 92, 94 in the cover part 20 and are threaded into respective threaded holes 96,98 in the legs 84 of the cover part 18, to thereby secure the two cover parts 18,20 together. As shown, the cover part 18 is formed with cut away side walls 100 and the cover part 20 is formed with complementary forwardly extending side walls 102. The side walls 102 do not entirely fill the cut away portion of the side walls 100, but instead provide a space 104 to accommodate therein the bowed-out portions of the spring clips 22,24. The cover part 20 is further formed with a socket aperture 106 on its rear wall 108 which leaves exposed the face 46 of the housing part 16 and is dimensioned to accept therein the sleeve 74 of the cover part 18 of an identical connector during stacked connector mating.

Figure 7:
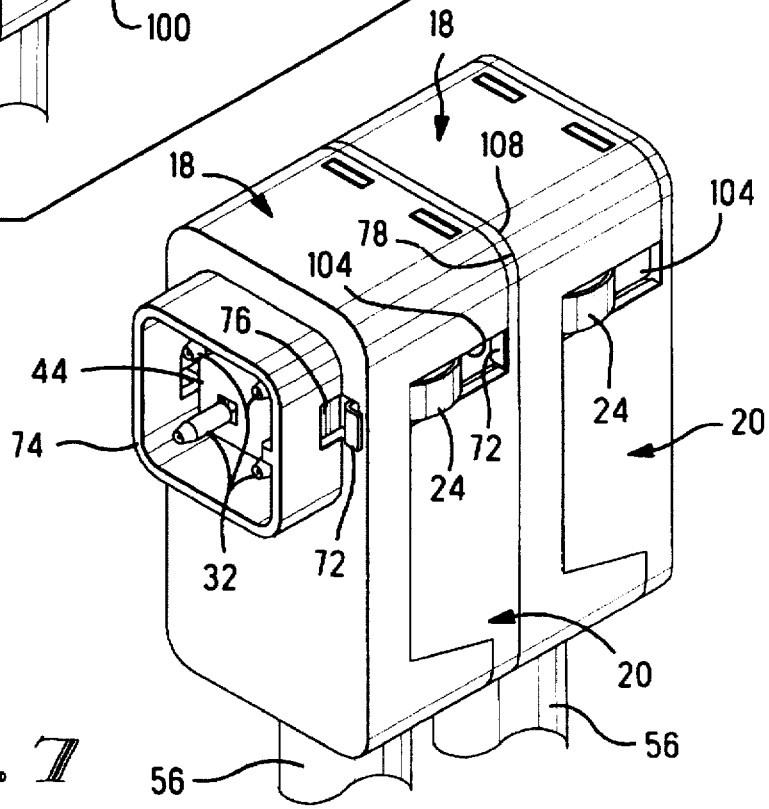
FIG. 7 shows the two connectors of FIG. 6 after having been mated.

When it is desired to stack a pair of connectors 10, they are brought into alignment With the front of one connector against the rear of another connector, as shown in FIG. 6. The connectors 10 are then brought together so that the sleeve 74 of the rear connector enters the socket aperture 106 of the front connector and the contact member plug portions 32 of the rear connector mate with the contact member receptacle portions 34 of the front connector. The connectors are then brought closer together and the vertically offset spring clips 22,24 of the rear connector are pressed inwardly, through the vertically offset spaces 104, so that the projections 72 enter the socket aperture 106 of the front connector. When the front wall 78 of the rear connector abuts the rear wall 108 of the front connector, the spring clips 22,24 are released and the projections 72 engage the peripheral edge surfaces of socket aperture 106 in rear wall 108 of the front connector and remain spring biased thereagainst. Projections 72 remain disposed within the spaces 104, as shown in FIG. 7, to thereby releasably secure the two connectors together and are exposed in spaces 104 to be delatched when desired, for unmating. In addition, the spring clips 22,24 provide ground continuity between the covers of stacked connectors. Several connectors can be stacked in this manner, and the forwardmost connector can then be plugged into an outlet receptacle.

To insure that when a pair of the connectors 10 are interconnected such interconnection is between corresponding ones of the contact members 12, a polarization arrangement is provided. This polarization arrangement includes the deep slot 110 (FIG. 2) on one side of the plug portion of the housing part 16 and the complementary rib 112 (FIG. 1) on the inner wall of the sleeve 74. Thus, there is only one relative orientation of two connectors 10 in which they can be interconnected.

As best shown in FIG. 4, one of the contact member plug portions 32 is longer than all of the other contact member plug portions. Preferably, this plug portion corresponds to the ground contact of the connector. Since this ground contact plug portion is the longest plug portion, it makes contact with its respective receptacle portion first, thereby assuring that ground contact is effected prior to any other contact, a desired safety feature.

Accordingly, there has been disclosed an improved stackable electrical connector. While an illustrative embodiment of the present invention has been disclosed herein, it is understood that various modifications and adaptations to the disclosed embodiment will be apparent to those of ordinary skill in the art and it is intended that this invention be limited only by the scope of the appended claims.

What is claimed is:

1. An electrical connector terminating a multi-wire cable and adapted for mating contact with another connector of identical construction so as to provide a stacked assembly of connectors with electrical continuity therebetween, the connector comprising:

a plurality of contact members each having complementary plug and receptacle portions, with the plug and receptacle portions of each contact member being oppositely directed along a major axis of said each contact member, each of said contact members further having means for contacting a respective wire of said cable; and an insulative housing for said plurality of contact members, said housing being formed with a plurality of parallel through-channels each for containing a respective one of said plurality of contact members so that said plug portions extend outwardly from a first face of said housing and said receptacle portions are accessible at a second face of said housing, said second face being parallel and opposed to said first face, said first and second faces being transverse to the major axes of said plurality of contact members, said housing being formed of two parts, with one of said housing parts being formed with means for holding the wires of said cable in spaced parallel relation.

2. The connector as set forth in claim 1 further comprising clip means mounted to said housing for releasably securing said connector to said another connector which is in mating contact therewith.

3. The connector as set forth in claim 1 wherein a particular one of said contact members is adapted to be a ground contact member, with the plug portion of said ground contact member being longer than the plug portion of all the other contact members, whereby when a pair of connectors are mated ground contact is effected prior to any other contact.

4. The connector as set forth in claim 1 wherein said first and second housing faces are orthogonal to said major axes of said plurality of contact members.

5. The connector as set forth in claim 1 wherein said housing parts meet substantially along a plane orthogonal to said major axes of said plurality of contact members.

6. The connector as set forth in claim 1 wherein said housing parts are formed with cooperating latch means for holding said housing parts together in two positions, a first of said positions being a preliminary assembly position wherein said housing parts are in spaced alignment with the contacting means of said contact members being spaced from said wires, and the other of said positions being a final assembly position wherein the contacting means of said contact members each engages a respective cable wire.

7. The connector as set forth in claim 6 wherein the latch means comprises:

a plurality of parallel resilient latch fingers formed on said one housing part and extending in parallel relation toward the other housing part, each of said latch fingers being formed with an elongated slot; and a plurality of latch projections formed on said other housing part, each of said latch projections corresponding to a respective one of said latch fingers, said latch projections being divided into two groups, the latch projections in a first group being so positioned that they snap into their respective latch finger slots when said housing parts are in said preliminary assembly position, the latch projections in the second group being so sized and positioned that they abut ends of their respective latch fingers when said housing parts are in said preliminary assembly position and snap into their respective latch finger slots when said housing parts are in said final assembly position.

8. The connector as set forth in claim 1 wherein:

said one housing part is formed with a plurality of parallel spaced channels for holding said cable wires, each of said parallel spaced channels intersecting a respective one of said contact member containing through-channels; and the contacting means of each of said contact members includes an insulation displacing contact portion extending into a respective one of said wire holding channels.

9. The connector as set forth in claim 8 wherein said contacting means of respective said contact members are relatively staggered axially along said channels.

10. The connector as set forth in claim 8 wherein said housing defines a space traversing ends of said channels and in communication with an outer surface of said housing, exposing ends of said wires for visual inspection upon wire insertion into said housing along respective said channels.

11. The connector as set forth in claim 10 wherein said housing includes an upper wall traversing said channels and bounding said space, providing a stop surface for ends of said wires during wire insertion.

12. The connector as set forth in claim 1 further comprising a cover formed of electrically conductive material surrounding said housing.

13. The connector as set forth in claim 12 further comprising clip means mounted to said housing and extending outwardly from said cover to cooperate with a cover of said another connector of identical construction for releasably securing said connector to said another such connector which is in mating contact therewith.

14. The connector as set forth in claim 13 wherein said clip means is formed of electrically conductive material, whereby ground continuity between covers of mating connectors is attained.

15. The connector as set forth in claim 12 wherein said cover is formed of two parts, with a first of said parts having an outwardly extending sleeve surrounding the contact member plug portions and the other of said parts being formed with a socket aperture dimensioned to accept therein the sleeve of said another such connector of identical construction.

16. The connector as set forth in claim 15 wherein said sleeve is formed with a rib on its inner wall and a complementary slot is formed on said housing extending away from said second face, whereby a pair of said connectors can be matingly engaged in only a predetermined relative orientation.

17. The connector as set forth in claim 15 wherein each of said cover parts is formed with a substantially semicircular opening for providing cable access to said housing, said connector further comprising a deformable cable strain relief clamp mounted to said first cover part between the cable access opening and the housing.

18. The connector as set forth in claim 17 wherein said cable has an exposed ground braid layer and said cable strain relief clamp is formed of electrically conductive material, whereby ground continuity between said cable and said cover is attained.

* * * * *